United States Patent [19]

Eyzaguirre

[11] Patent Number: 4,575,951

[45] Date of Patent: Mar. 18, 1986

[54] CLOSED CHAMBER DRYER

[76] Inventor: Ramon C. Eyzaguirre, 5217 Harrison St., Hollywood, Fla. 33021

[21] Appl. No.: 596,727

[22] Filed: Apr. 4, 1984

[51] Int. Cl.[4] ..... F26B 3/04

[52] U.S. Cl. ..... 34/30; 34/48; 34/54; 34/67; 34/235

[58] Field of Search ..... 34/22, 30, 48, 54, 55, 34/62, 67, 202, 219, 235; 219/385, 386, 387, 400

[56] References Cited

U.S. PATENT DOCUMENTS

| | | | |
|---|---|---|---|
| 1,902,575 | 3/1933 | Nichols | 34/219 |
| 2,831,267 | 4/1958 | Gardner | 34/219 |
| 3,251,139 | 5/1966 | Strimling | 34/219 |
| 3,574,953 | 4/1971 | Furnell | 34/219 |
| 4,195,415 | 4/1980 | Livings et al. | 34/48 |
| 4,335,290 | 6/1982 | Teich | 219/400 |
| 4,369,347 | 1/1983 | Shin | 219/400 |
| 4,374,319 | 2/1983 | Guibert | 219/400 |
| 4,439,459 | 3/1984 | Swartley | 219/400 |

*Primary Examiner*—Larry I. Schwartz
*Assistant Examiner*—David W. Westphal
*Attorney, Agent, or Firm*—Eugene F. Malin

[57] ABSTRACT

Disclosed is a dryer for drying articles, such as laboratory glassware. The dryer is in the form of a sealable cabinet having an internal heater, and ducting in the form of a closed circulatory loop connected to an external blower. By recirculating air through the dryer, rather than blowing air in one side of the cabinet and out the other, the air can be heated to a much higher temperature, thus drying the articles much more quickly and thoroughly, and reducing appreciably the time of a drying cycle. Additionally, because the dryer conserves heated air by recirculating it, the dryer consumes far less power than prior dryers of equivalent capacity, making it possible to use standard commercial power sources to operate this dryer, rather than the more expensive three phase power supplies now typically used.

13 Claims, 3 Drawing Figures

CLOSED CHAMBER DRYER

BACKGROUND OF THE INVENTION

This invention pertains to dryers for articles, such as laboratory glassware, that effect drying by blowing heated air across wet articles located in a drying cabinet.

Prior dryers typically employ cabinets in which are located radiant heating elements. Air is blow across these cabinets, that is in one side and out the other, such air being heated by the heating element as it passes through the cabinet. This scheme for drying wet articles has several major deficiencies: Because the air is exposed to the heater for only a short period of time, the temperature of the drying air is never very great, and drying efficiency relatively poor; additionally, because the heated air leaves the system immediately upon traversing the cabinet, a tremendous amount of heat is rejected to the environment during each drying cycle; and because air is blown through rather than circulated in, the cabinet, there is typically poor mixing of the air within the cabinet, resulting in temperature gradients within the cabinet and less effective drying in the cabinet's cooler locations. For these reasons, a typical drying cycle requires a power supply that can deliver very high power, and expensive three phase power supplies are normally used.

SUMMARY OF THE INVENTION

Accordingly, it is an object of this invention to remedy the deficiencies of the prior art by providing a dryer that increases both electrical and drying efficiency by increasing the temperature of the drying air.

It is a further object of the invention to provide such a dryer that can use a standard wall outlet as a power source.

It is a further object of the invention to appreciably shorten the time of the drying cycle.

In accordance with these and other objects that shall become apparent hereinafter there is provided a dryer and method for using the dryer that recirculates air inside the cabinet, rather than blowing air across the cabinet. Initially, air is preheated by a heating element within the cabinet, and once the blowers begin circulating air in a closed loop through the dryer the same element keeps heating the air as it is recirculated. This scheme quickly heats the air to a very high temperature, at which evaporation is much more efficient. Because the circulation loop is a closed one, heated air is not continually rejected to the environment, and the power necessary to operate the dryer is greatly reduced.

As an additional feature, after the drying cycle is completed, the cabinet can be opened to the atmosphere and cool atmospheric air blown through the cabinet in order to cool the glassware sufficiently for human handling.

The instant invention will be more fully understood in the following detailed description, it being understood, however, that the invention is capable of extending application, and is not confined to the precise disclosure. Changes and modifications may be made that do not affect the spirit of the invention, nor exceed the scope thereof, as expressed in the appended claims. Accordingly, the instant invention will now be described with particular reference to the accompanying drawings.

DETAILED DESCRIPTION OF THE PREFERRED EMBODIMENT

Figure 1:
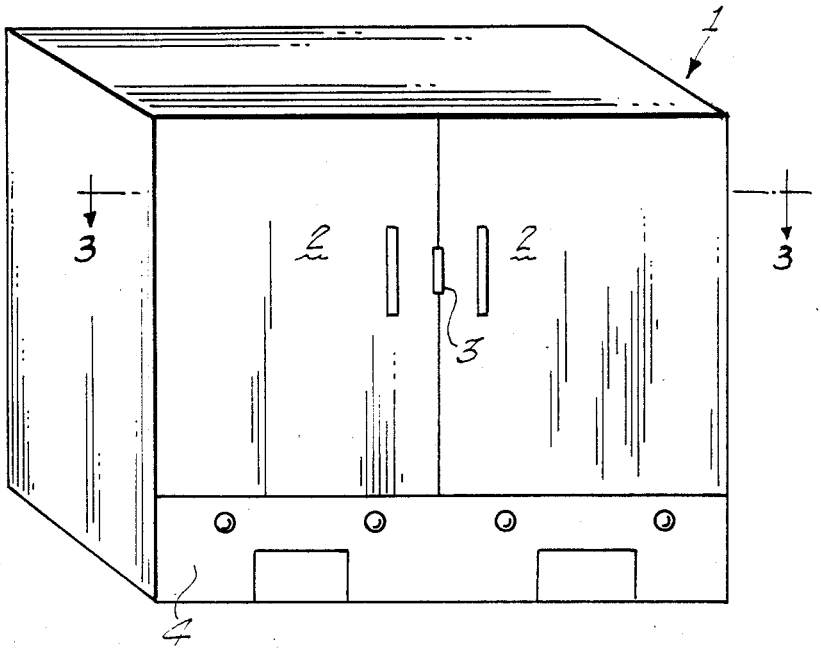
FIG. 1 is a perspective view of the dryer cabinet of the instant invention.

With reference to the drawings, in particular FIG. 1, there is shown a dryer cabinet generally at 1. Cabinet 1 has doors 2, secured by a lock 3. The edges of doors 2 should optimally be provided with a packing of thermal insulation. Below doors 2 is control panel 4.

Figure 2:
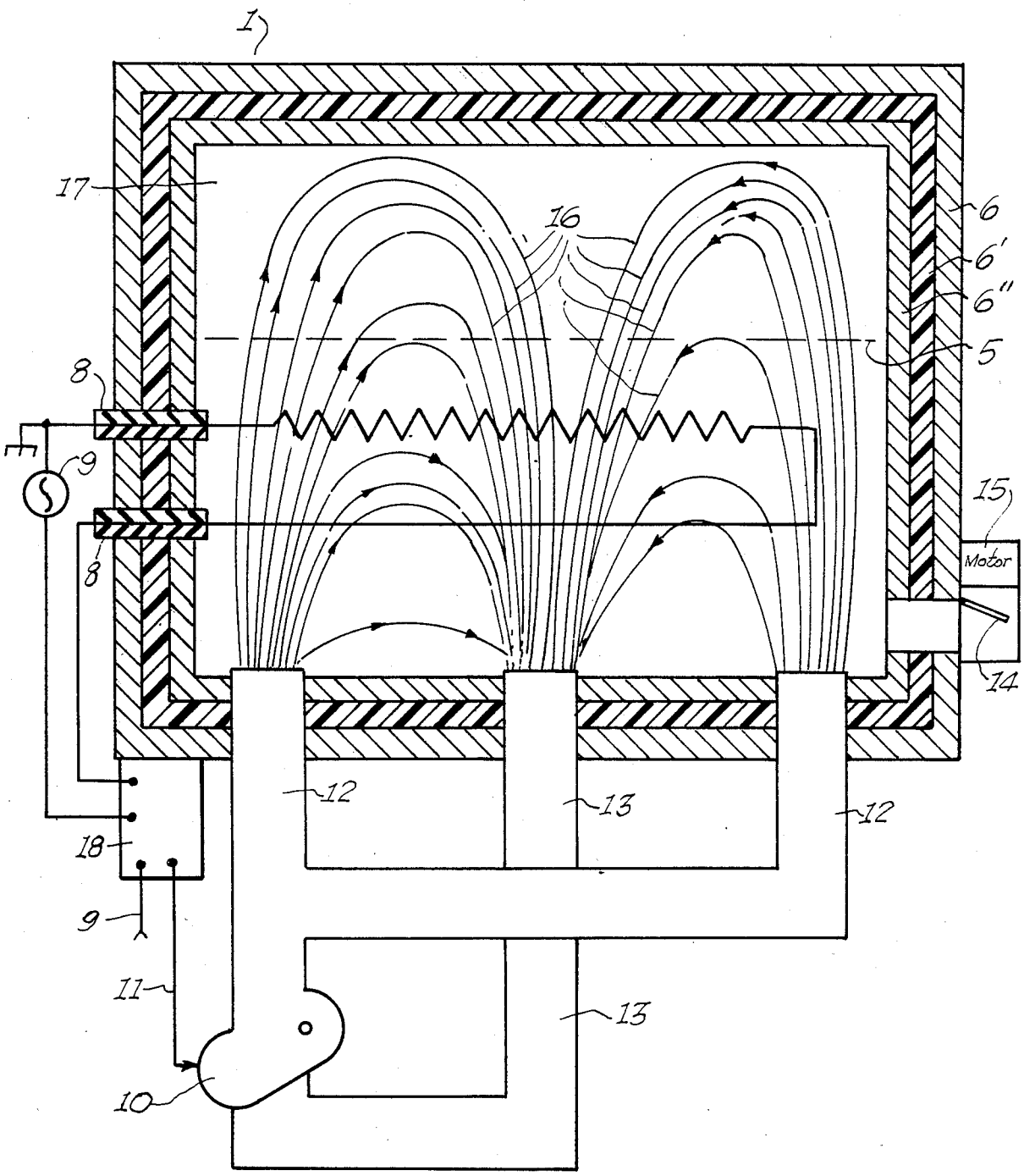
FIG. 2 is a horizontal section through such a cabinet, showing additional apparatus of the instant invention.

FIG. 2 shows the details of the interior of cabinet 1, generally shown at 17. Rack 5 is used for holding articles to be dryed inside the cabinet. The cabinet has several layers of insulation, an outer layer 6 and an inner layer 6'', each typically made of metal, and a central layer 6', made of appropriate thermal insulation, such as urethane. The articles are heated by electric heating element 7, which is connected through penetrations 8 to AC power source 9. Air is circulated through interior chamber 17 by blower 10, which drives air through lines 12 along flow path 16 to return line 13 in a closed loop. Door 14 can open and close to connect or isolate chamber 17 from the outside atmosphere. Motor 15 operates to open and close door 14. Both heating element 7 and blower 10 are switched on and off at appropriate times in the cycle by controller 18, which consists of logical elements that determine the operation of various portions of the cycle, in particular the switching on and off of heating element 7 and of blower 10, and of the opening of door 14. Thermocouple 9 provides an input to controller 18 representing the internal temperature of chamber 17.

In the preferred embodiment, controller 18 is of standard electronic logical elements, and operates the entire drying cycle automatically from start to finish. Electronic switches and timers are preferred because of their cost, reliability, and durability.

As a safety feature, a redondant thermal switch to disconnect power source 9 from heating element 7 to ensure that the dryer shall not overheat were controller 18 to malfunction.

Figure 3:
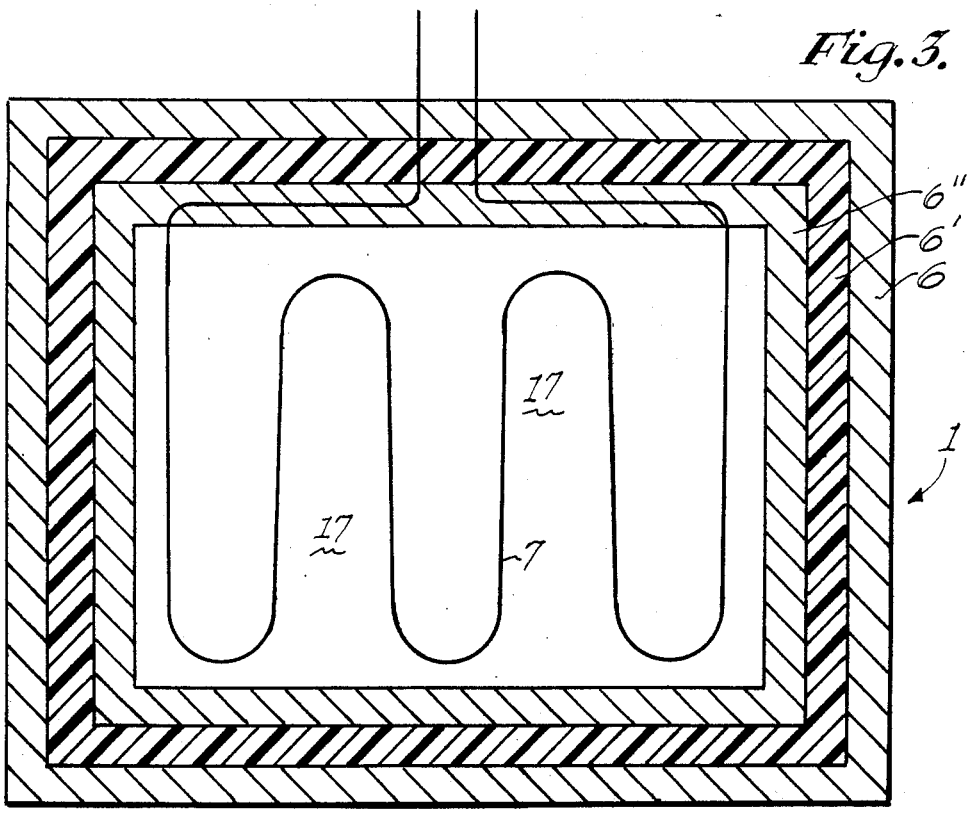
FIG. 3 is a view along lines 3—3 of FIG. 1, showing a preferred form of the heating element.

FIG. 3 shows a preferred form of the heating element 7. Element 7 is in a serpentine shape to increase the area of contact between element 7 and the air within chamber 17.

In operation, articles to be dryed are placed on rack 5, and doors 2 closed and locked. An operator chooses an appropriate pre-heat temperature and an appropriate operating temperature, and sets these on control panel 4, that is inputs them to controller 18, and begins the drying cycle. Heating element 7 heats air within chamber 17 until the pre-heat temperature is reached, at which time controller 18 starts blower 10 and air begins circulating along flow path 16 within chamber 17. This flowpath causes the air in the closed circulatory loops 12, 13, 17 to be mixed thoroughly in chamber 17, preventing the temperature gradients characteristic of the prior art. Heating element 7 continues to heat the air as it circulates through chamber 17 until the desired operating temperature is reached at which time controller 18 turns off heating element 7. This recirculation is continued for a preselected time period, after which controller 18 turns off blower 10 (and heating element 7 if element 7 has not already been turned off). Controller 18 then signals motor 15 to open door 14, exposing chamber 17 to the atmosphere. Controller 18 then turns blower 14 back on, causing air to be sucked in through door 14 into air line 13 to blower 10 back into chamber 17 and out door 14. This flow through of atmospheric air quickly cools chamber 17 and the articles within chamber 17. After a further preselected time, controller 18 stops blower 10, and the operator can then open doors 2 and remove the dryed articles.

Of course, the operating parameters of the dryer will vary with varying applications, however, typical drying temperatures heretofore used by the Applicant would be a preheat temperature of 150° C., and an operating temperature of 360° C. Typical drying time would be six to seventeen minutes, contrasted to thirty to forty-five minutes typical of the prior art. Power consumption during operation is about 6 kilowatts, in contrast to 18 kilowatts of the prior art.

Although the invention as here described has an automatic cycle controlled by member 18, it is to be understood that the various parts of the cycle can be initiated manually, or that one could employ a plurality of blowers (or one blower with a booster blower for the cool-down phase) rather than the one blower as described above. Indeed, the instant invention has been shown and described herein in what is considered to be the most practical and preferred embodiment. It is recognized, however, that departures may be made therefrom within the scope of the invention, and that obvious modifications may occur to a person skilled in the art, and that the metes and bounds of the invention are to be determined solely from the appended claims.

What I claim is:

1. A method for drying articles comprising the steps of:

providing an air-containing environment closed to the ambient;

including articles in said air-containing closed environment;

directly heating the air in said environment;

thereafter circulating said heated air in said environment in a circulation circuit closed to the ambient for drying said articles whereby effecting more efficieint drying of said articles;

said step for heating includes the step for directly preheating said air in said environment to a preselected preheat temperature prior to said step for circulating; and cooling said environment after said step for circulating by introducing cool air from the ambient.

2. The method of claim 1, wherein said heating is effected by an electric heating element and wherein said step for preheating is effected by said heating element thereby generating radiant heat within said environment.

3. The method of claim 2, wherein said method for drying comprises controlling the air flow and temperature within said environment, and wherein said step for circulating comprises the steps of:

controlling the air flow sensing a first preselected temperature, said first preselected temperature being said preselected preheat temperature;

controlling said electric heating sensing a second preselected temperature, said second preselected temperature being greater than said first preselected temperature.

4. The method of claim 3, wherein said steps for cooling said environment comprises the step of:

sensing the temperature and in response thereto effecting passageway of cool ambient air into said environment to cool said articles.

5. The method of claim 1, including the step of sensing the temperature within said environment, and controlling air circulation responsive to said temperature sensing a first preselected temperature; and controlling said electric heating responsive to said temperature sensing a second preselected temperature, said second preselected temperature being greater than first preselected temperature.

6. The method of claim 5, wherein said drying step comprises providing communication of said environment to said atmosphere; and automatically controlling said communication.

7. The method of claim 1, wherein said drying step comprises providing communication of said environment controlling access of said environment to said atmosphere cooling step is effected by controlling said access.

8. An apparatus for drying articles, said apparatus comprising:

a housing forming a drying and cooling chamber;

said housing being so constructed to be closed to the ambient during drying of the articles;

a means disposed within the chamber for heating the air within said chamber;

a means for circulating said heated air within said chamber in a circulation loop closed to the ambient for drying said articles, whereby effecting more efficient drying of said articles;

said apparatus further comprises a control means and a temperature sensor means, said control means being effective to switch on said means for circulating responsive to said temperature sensor sensing a first predetermined temperature, said control means being effective to switch on said means for heating responsive to said temperature sensor sensing a second predetermined temperature, said first temperature being greater than said second temperature, said apparatus further comprising a means for cooling said chamber.

9. The apparatus of claim 8, wherein said means for heating is an electric heating element.

10. The apparatus of claim 9, wherein said means for circulating comprises a blower arranged to circulate said air in said chamber through said closed circulation loop.

11. The apparatus of claim 8, wherein said means for circulating comprises a blower arranged to circulate said air in said chamber through said closed circulation loop.

12. The apparatus of claim 11, wherein said means for circulating comprises a vent having a door and a means for opening said door, said door being effective to open said closed circulation loop to the atmosphere, thereby constituting with said blower a means for cooling said chamber by blowing cool atmospheric air through said chamber; and wherein said control means is effective to cause said means for opening to open said door a predetermined time period after said control means switches off said means for heating.

13. The apparatus of claim 8, wherein said means for cooling comprises a vent having a door and a means for opening said door, and wherein said door by opening is effective to open said closed circulation loop to the atmosphere, thereby constituting with said blower a means for cooling said chamber by blowing cool atmospheric air through said chamber; and wherein said control means is effective to cause said means for opening to open said door a predetermined time period after said control means switches off said means for heating.

* * * * *